US012029298B2

(12) United States Patent
Richardson

(10) Patent No.: US 12,029,298 B2
(45) Date of Patent: Jul. 9, 2024

(54) BOWL FOR HAIR COLORING BRUSH

(71) Applicant: Jackie Richardson, St Louis, MO (US)

(72) Inventor: Jackie Richardson, St Louis, MO (US)

( * ) Notice: Subject to any disclaimer, the term of this patent is extended or adjusted under 35 U.S.C. 154(b) by 808 days.

(21) Appl. No.: 15/609,732

(22) Filed: May 31, 2017

(65) Prior Publication Data

US 2018/0035778 A1 Feb. 8, 2018

Related U.S. Application Data

(63) Continuation-in-part of application No. 15/226,813, filed on Aug. 2, 2016, now Pat. No. 10,420,408.

(51) Int. Cl.

| | |
|---|---|
| ***A45D 19/06*** | (2006.01) |
| ***A45D 19/00*** | (2006.01) |
| ***A46B 5/02*** | (2006.01) |
| ***A46B 9/02*** | (2006.01) |
| ***A46B 15/00*** | (2006.01) |

(52) U.S. Cl.

CPC ..... *A45D 19/06* (2013.01); *A45D 19/012* (2021.01); *A46B 5/02* (2013.01); *A46B 9/023* (2013.01); *A46B 15/0059* (2013.01); *A45D 19/0066* (2021.01); *A46B 2200/104* (2013.01)

(58) Field of Classification Search

CPC ..... A45D 19/0008; A45D 19/06; A45D 2019/0066; A45D 34/00; A45D 19/12; A47G 19/065; A47G 19/12; A47J 27/21; A47J 31/005; A47J 43/0727; B44D 3/126; B65D 25/2802; B65D 25/2811; B65D 25/282; B65D 25/2832; B65D 25/2885; G01F 19/002; G01F 19/00

USPC ..... 119/61.5, 61.54, 61.56, 61.57; 220/756

See application file for complete search history.

(56) References Cited

U.S. PATENT DOCUMENTS

| | | | | |
|---|---|---|---|---|
| 1,681,569 | A * | 8/1928 | Brueck | A45D 19/06 132/73.5 |
| 2,017,567 | A * | 10/1935 | Meyer | A45D 19/02 401/123 |
| 3,349,781 | A | 10/1967 | Poole et al. | |
| 5,289,835 | A | 5/1994 | Harlan et al. | |
| 5,511,279 | A * | 4/1996 | Ippolito | B44D 3/126 15/257.06 |
| 6,332,556 | B1 * | 12/2001 | Shalman | B44D 3/126 220/570 |
| D457,995 | S * | 5/2002 | Clark | D32/53.1 |
| D483,917 | S * | 12/2003 | Frantz | B44D 3/126 D32/53.1 |
| 6,708,838 | B2 * | 3/2004 | Bergman | B44D 3/12 220/757 |
| 6,802,431 | B2 * | 10/2004 | Schinkel | B05C 17/0245 220/570 |
| D549,913 | S * | 8/2007 | Bergman | D32/53 |
| 8,118,037 | B2 | 2/2012 | Cardenas et al. | |
| D756,049 | S * | 5/2016 | Arvinte | D32/53 |
| 2006/0231115 | A1 | 10/2006 | McNamara | |
| 2006/0243732 | A1 * | 11/2006 | Bergman | B44D 3/126 220/757 |
| 2007/0144550 | A1 | 6/2007 | Roher | |

(Continued)

*Primary Examiner* — Nicholas D Lucchesi
*Assistant Examiner* — Jennifer Gill
(74) *Attorney, Agent, or Firm* — David H. Chervitz

(57) ABSTRACT

A bowl is disclosed having a basin portion having a slanted back wall portion, a bottom portion, a front straight wall portion, a pair of side wall portions, and a top portion, and a handle extending from the top portion.

12 Claims, 15 Drawing Sheets

(56) References Cited

U.S. PATENT DOCUMENTS

| | | | | |
|---|---|---|---|---|
| 2010/0140275 | A1* | 6/2010 | Billado, Jr. | B44D 3/127<br>220/570 |
| 2011/0114107 | A1 | 5/2011 | Muhl et al. | |
| 2014/0090992 | A1* | 4/2014 | Kim | A45D 19/0008<br>206/219 |

* cited by examiner

BOWL FOR HAIR COLORING BRUSH

RELATED APPLICATION

This application is a continuation-in-part of U.S. patent application Ser. No. 15/226,813 that was filed on Aug. 2, 2016, the disclosure of which is incorporated herein by reference.

BACKGROUND OF THE DISCLOSURE

This disclosure relates to a bowl for a hair brush and more particularly to a bowl for containing hair coloring to be used with a hair coloring brush.

Hair coloring is a complex technique in which a color dye is applied to hair to change, cover, or enhance the natural color of hair. A color dye is made by mixing various colors and chemicals in a receptacle to obtain a desired color to be applied to hair. Once the desired color is obtained the color is slowly and laboriously applied to sections of hair by a brush. As can be appreciated, this is a time consuming process which may take up to forty-five minutes or more before the color is properly applied in a desired amount. Compounding this problem is the fact that the brushes being used to apply the color are small and only cover a portion of a section of hair to be dyed. Multiple strokes or passes are required to dye a section of hair. This adds to the time and energy required to dye hair. Also, if a colorist is being used then the amount charged by the colorist is increased due to the increased time required to apply dye to hair. It is also know that the receptacle or bowl in which dye and other chemicals are mixed is not large and only a small batch of dye may be mixed at a time. In view of this, if the amount of dye is underestimated then another batch may have to be mixed. Again, this adds to the time and expense of dyeing hair.

The present hair coloring brush is designed to obviate and overcome many of the disadvantages and shortcomings associated with prior bowls used with hair coloring brushes. Further, the present bowl is large enough so that the bowl may be used with a hair coloring brush that has increased surface area for applying dye to a larger area or section of hair. Moreover, the present bowl may be part of a hair coloring brush system that employs the bowl for holding a color dye and a hair coloring brush that has a large surface area for applying the color dye from the bowl.

SUMMARY OF THE DISCLOSURE

In one form of the present disclosure, a bowl is disclosed which comprises a basin portion having a slanted back wall portion, a bottom portion, a front straight wall portion, a pair of side wall portions, and a top portion, and a handle extending from the top portion.

In another form of the present disclosure, a bowl comprises a basin portion having a slanted back wall portion, a bottom portion having a ledge portion, a front straight wall portion, a pair of side wall portions, and a top portion, and a handle extending from the top portion.

In yet another form of the present disclosure, a hair coloring brush system is disclosed which comprises a hair coloring brush comprising a central base portion, a pick handle extending from the central base portion, a plurality of bristles extending out from the central base portion, the bristles each have an end portion with the end portions forming a curved surface, and a bowl for holding a quantity of dye, the bowl comprising a basin portion having a slanted back wall portion, a bottom portion, a front straight wall portion, a pair of side wall portions, a top portion, and a handle extending from the top portion with the basin for receiving the bristles and the central base portion of the hair coloring brush.

In light of the foregoing comments, it will be recognized that the present disclosure provides a bowl for use with a hair coloring brush that is of simple construction and design and which can be easily employed with highly reliable results.

The present disclosure also provides a bowl for use with a hair coloring brush that employs lightweight structures or components to allow an operator to use the bowl for extended periods of time without fatigue.

The present disclosure further provides a bowl for use with a hair coloring brush that allows for a large amount of dye to be held within the bowl for the dye to be applied to hair quickly.

The present disclosure is also directed to a bowl for use with a hair coloring brush that allows dye to be applied to a large section of hair to reduce the time required for applying dye.

The present disclosure provides a bowl for use with a hair coloring brush that conforms to the shape of the hair coloring brush.

The present disclosure is directed to a bowl that is easy to grasp and manipulate during use.

The present disclosure is further directed to a bowl for use with a hair coloring brush system that provides for a large section of hair to be colored in a short amount of time.

The present disclosure is also directed to a bowl that is formed to provide a rest area for holding a hair coloring brush.

These and other objects and advantages of the present disclosure will become apparent after considering the following detailed specification in conjunction with the accompanying drawings, wherein

DETAILED DESCRIPTION OF THE EMBODIMENTS

Figure 1:
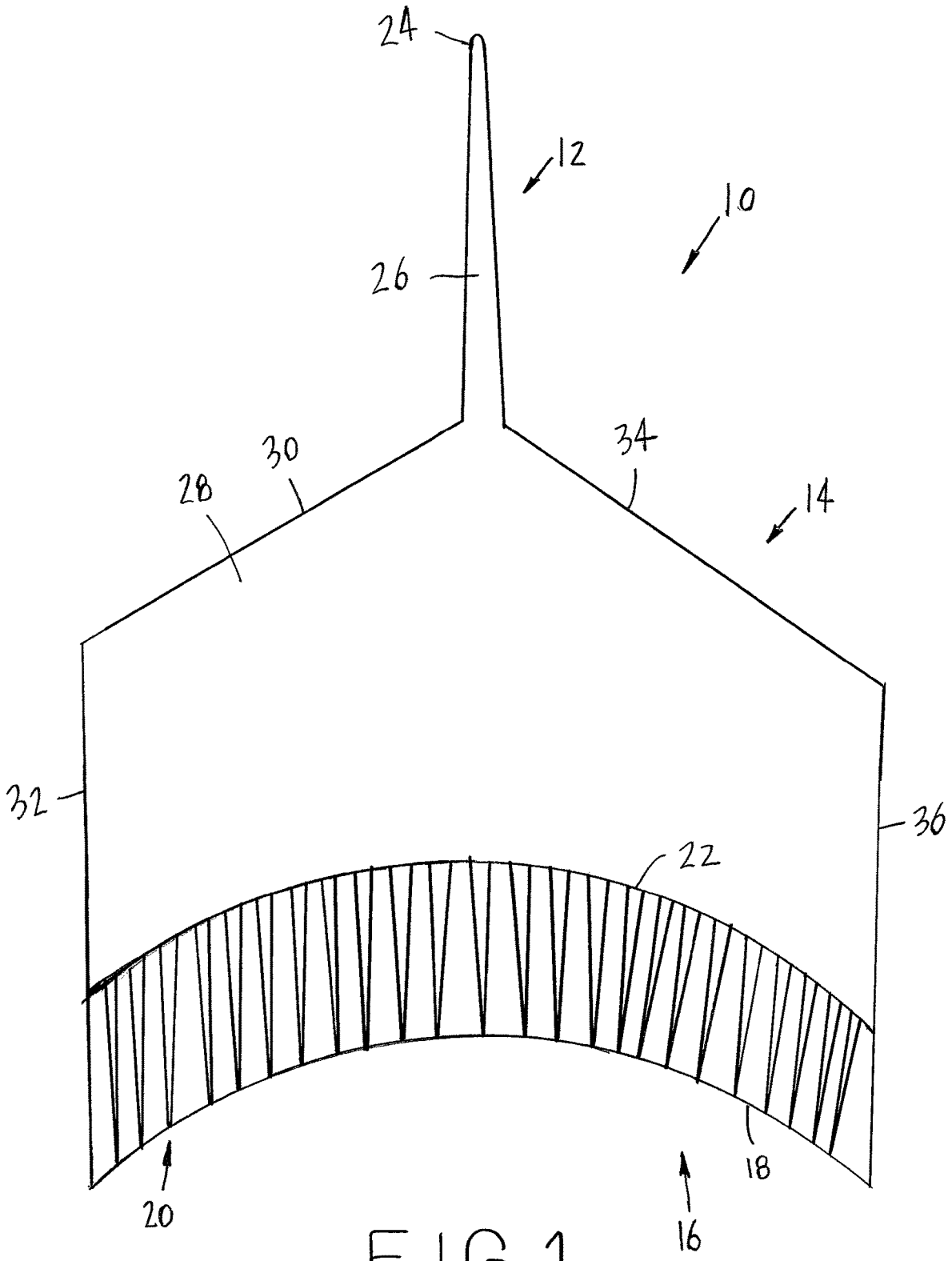
FIG. 1 is a front perspective view of a hair coloring brush constructed according to the present disclosure.

Referring now to the drawings, wherein like numbers refer to like items, number 10 identifies an embodiment of a hair coloring brush constructed according to the present disclosure. With reference now to FIG. 1, the hair coloring brush 10 is shown comprising a pick handle 12, a central base portion 14, and a plurality of bristles 16 extending out from the central base portion 14. The bristles 16 each have an end portion 18 with the end portions 18 forming a curved surface 20. The central base portion 14 has a curved end portion 22 from which the bristles 16 extend. The pick handle 12 has an end 24 and a tapered portion 26 that extends from the central base portion 14 to the end 24. The pick handle 12 is used to assist in sectioning hair that needs to be colored or dyed by the brush 10. The central base portion 14 has a front side 28 that is large and is adapted for a hand of an operator of the brush 10 to be able to firmly grasp. The central base portion 14 also has a first angled side portion 30, a first straight side portion 32, a second angled side portion 34, and a second straight side portion 36. The first angled side portion 30 is between the tapered portion 26 and the first straight side portion 32. The first straight side portion 32 ends at the curved end portion 22. The second angled side portion 34 is between the tapered portion 26 and the second straight side portion 36. The second straight side portion 36 also terminates at the curved end portion 22. As can be appreciated, the curved surface 20 of the end portions 18 of the bristles 16 are used to follow the contoured shape of a head. In this manner, it will be easy to stroke hair with dye (not shown) applied to the brush 10 or apply dye to hair by using the brush 10. The curved end portion 22 provides a guide for applying dye to hair associated with the contoured shape of the head. By way of example only, the distance between the first straight side portion 32 and the second straight side portion 36 may be between 2¾ inches and 7 inches. The brush 10 has the central base portion 14 wider or larger than any prior brush which results in a wider or larger surface 20 than any prior brush will allows more dye to be applied to hair in one stroke of the brush 10. Further, although the side portions 30, 32, 34, and 36 are disclosed, it is to be understood that the central base portion 14 may be produced having any side portions such as a square shape, a rectangular shape, or a semicircular shape.

Figure 2:
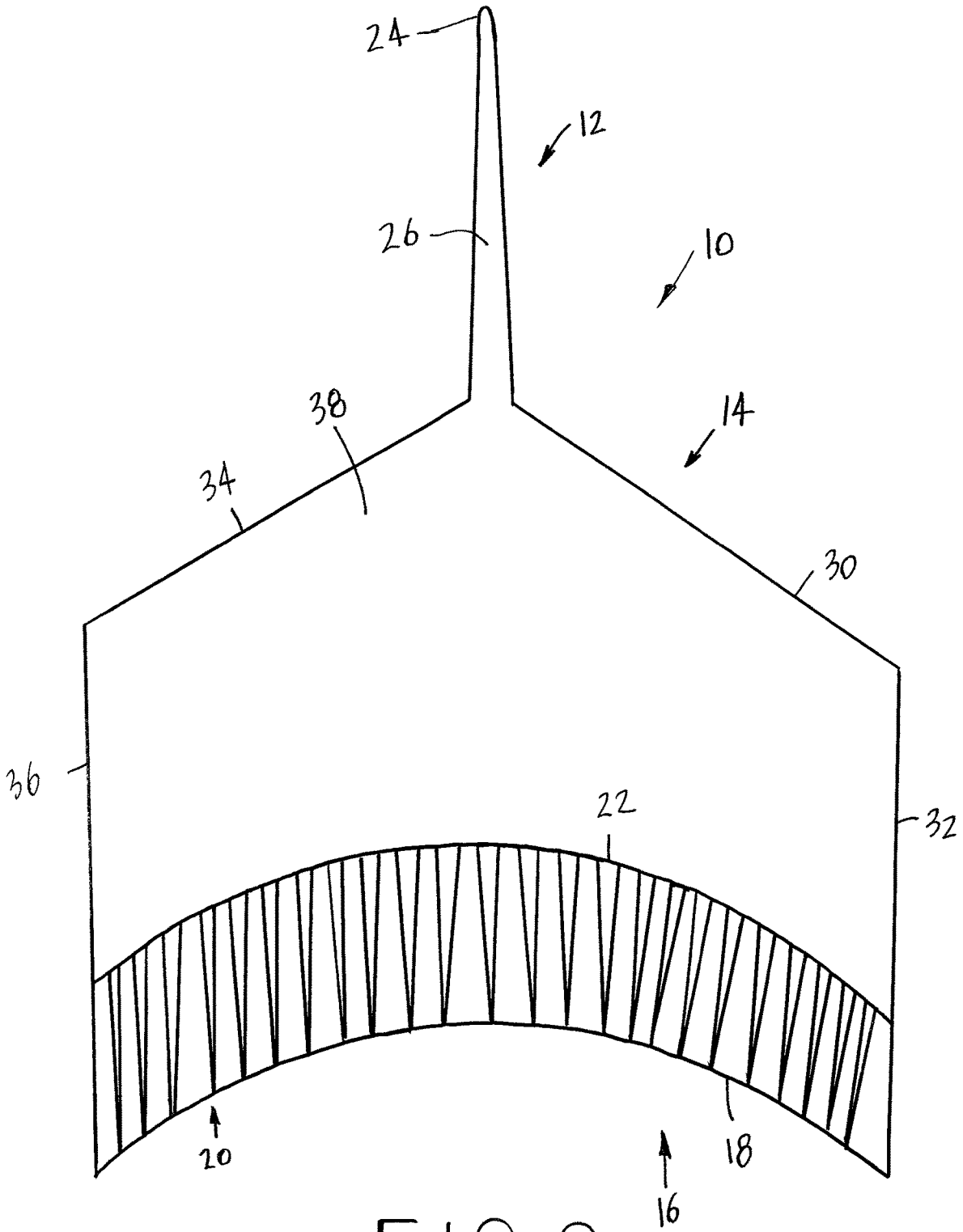
FIG. 2 is a back perspective view of the hair coloring brush shown in FIG. 1 constructed according to the present disclosure.

FIG. 2 illustrates a back perspective view of the hair coloring brush 10. The hair coloring brush 10 is shown comprising the pick handle 12, the central base portion 14, and the plurality of bristles 16 extending out from the central base portion 14. The bristles 16 each have the end portion 18 with the end portions 18 forming the curved surface 20. The central base portion 14 also has the curved end portion 22 from which the bristles 16 extend. The pick handle 12 has the end 24 and the tapered portion 26 that extends from the central base portion 14 to the end 24. The central base portion 14 has a back side 38 that is large and is adapted for a hand of an operator of the brush 10 to be able to firmly grasp. The central base portion 14 is also shown having the first angled side portion 30, the first straight side portion 32, the second angled side portion 34, and the second straight side portion 36.

Figure 3:
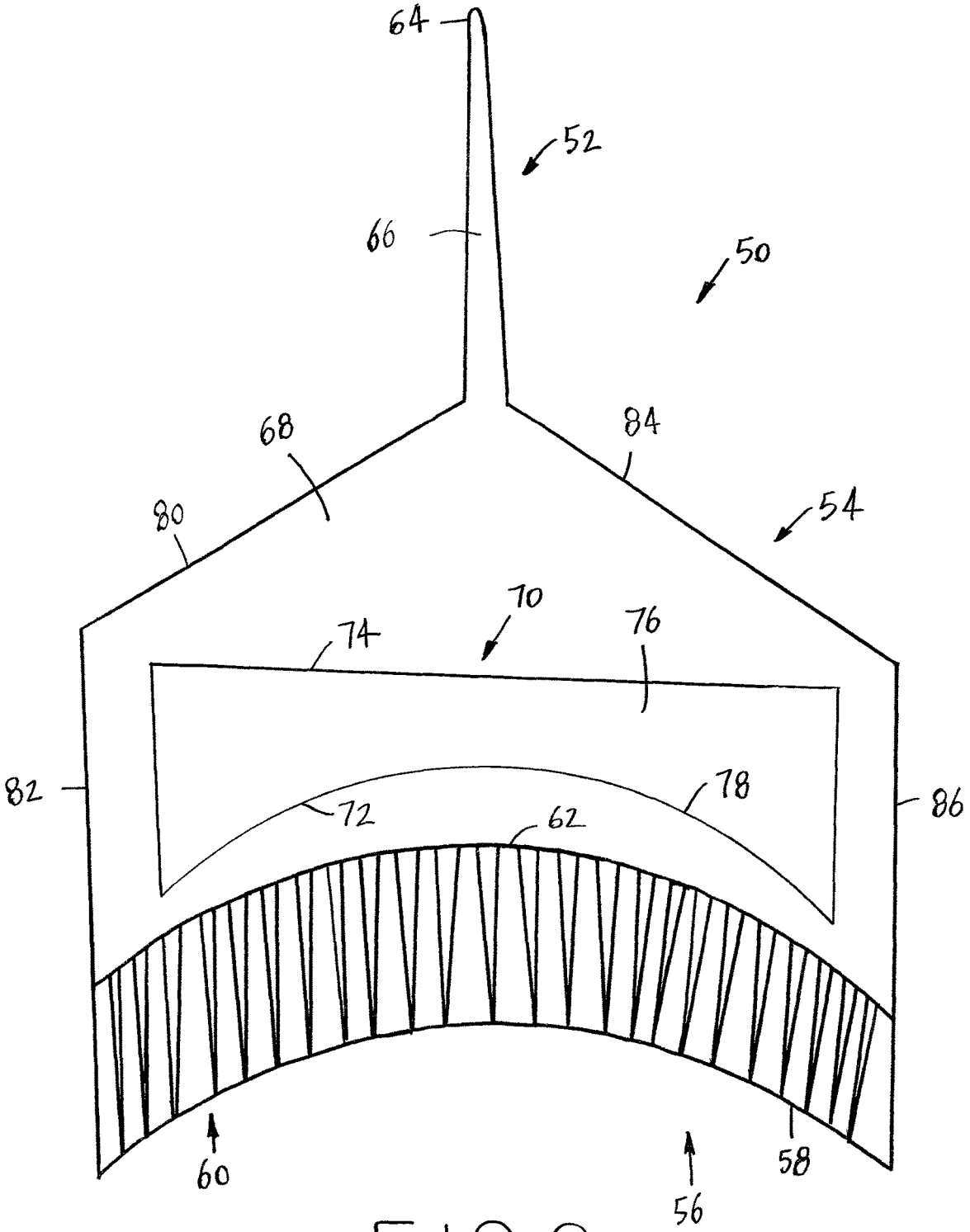
FIG. 3 is a front perspective view of another embodiment of a hair coloring brush constructed according to the present disclosure.

With reference now to FIG. 3, another embodiment of a hair coloring brush 50 is shown. The hair coloring brush 50 comprises a pick handle 52, a central base portion 54, and a plurality of bristles 56 extending out from the central base portion 54. The bristles 56 each have an end portion 58 with the end portions 58 forming a curved surface 60. The central base portion 54 has a curved end portion 62 from which the bristles 56 extend. The pick handle 52 has an end 64 and a tapered portion 66 that extends from the central base portion 54 to the end 64. The pick handle 52 is used to assist in sectioning hair that needs to be colored or dyed by the brush 50. The central base portion 54 has a front side 68 that is large and is adapted for a hand of an operator of the brush 50 to be able to firmly grasp. The central base portion 54 has an indentation 70 formed in the front side 68. The indentation 70 has a curved bottom end 72 and a straight upper end 74. The indentation 70 provides an area 76 for grasping the brush 50 in a comfortable manner by an operator or use of the brush 50. The curved bottom end 72 provides a surface 78 against which fingers of an operator may be positioned for more control of the brush 50. The central base portion 54 also has a first angled side portion 80, a first straight side portion 82, a second angled side portion 84, and a second straight side portion 86. The first angled side portion 80 is between the tapered portion 66 and the first straight side portion 82. The first straight side portion 82 ends at the curved end portion 62. The second angled side portion 84 is between the tapered portion 66 and the second straight side portion 86. The second straight side portion 86 also terminates at the curved end portion 62. As can be appreciated, the curved surface 60 of the end portions 58 of the bristles 56 are used to follow the contoured shape of a head. In this manner, it will be easy to stroke hair with dye (not shown) applied to the brush 50 or apply dye to hair by using the brush 50. The curved end portion 62 provides a guide for applying dye to hair associated with the contoured shape of the head.

Figure 4:
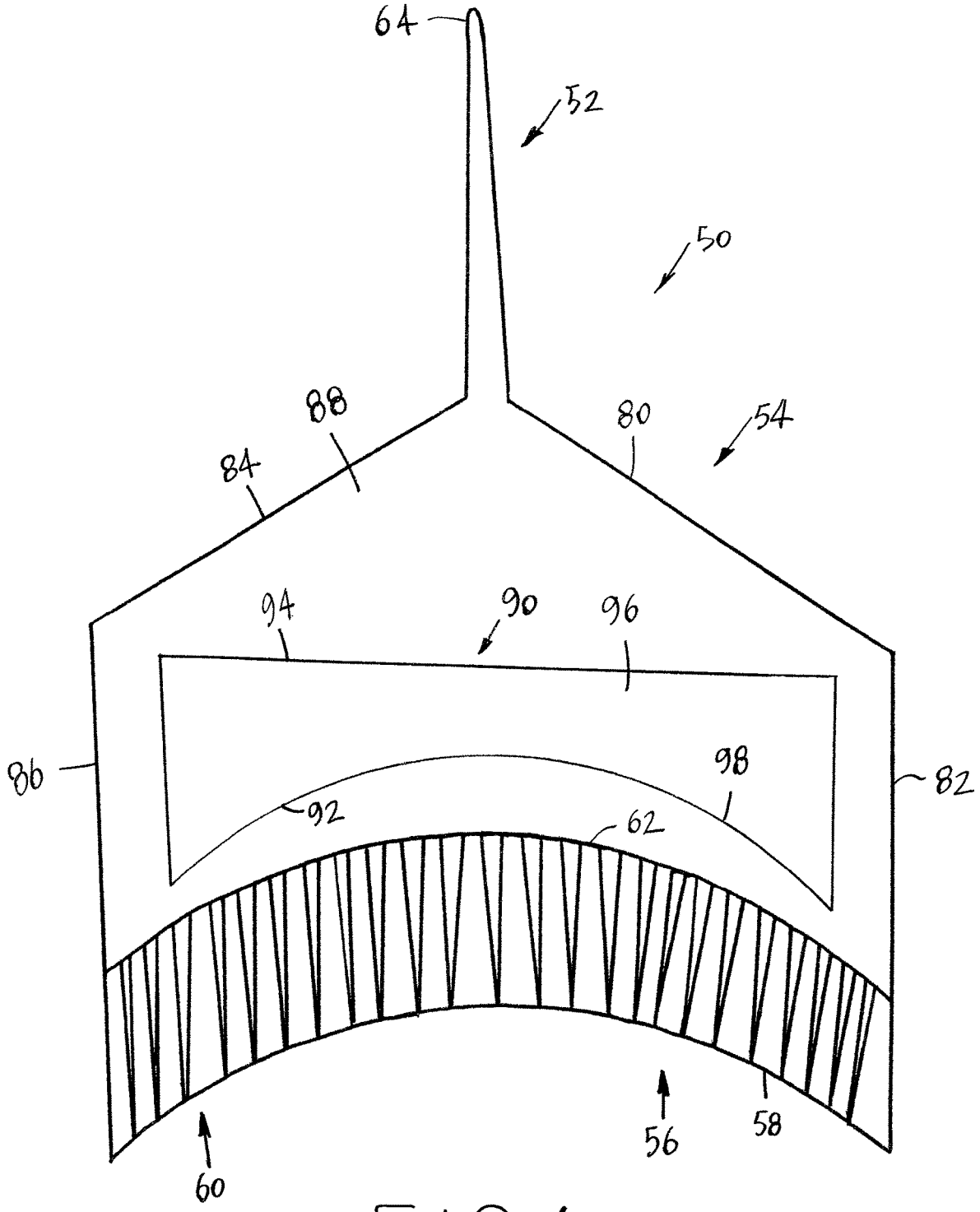
FIG. 4 is a back perspective view of the hair coloring brush shown in FIG. 3 constructed according to the present disclosure.

FIG. 4 depicts a back perspective view of the brush 50. The hair coloring brush 50 is shown comprising the pick handle 52, the central base portion 54, and the plurality of bristles 56 extending out from the central base portion 54. The bristles 56 each have the end portion 58 with the end portions 58 forming the curved surface 60. The central base portion 54 also has the curved end portion 62 from which the bristles 56 extend. The pick handle 52 has the end 64 and the tapered portion 66 that extends from the central base portion 54 to the end 54. The central base portion 54 has a back side 88 that is large and is adapted for a hand of an operator of the brush 50 to be able to firmly grasp. The central base portion 54 is also shown having the first angled side portion 80, the first straight side portion 82, the second angled side portion 84, and the second straight side portion 86. The central base portion 54 has an indentation 90 formed in the back side 88. The indentation 90 has a curved bottom end 92 and a straight upper end 94. The indentation 90 provides an area 96 for grasping the brush 50 in a comfortable manner by an operator or use of the brush 50. The curved bottom end 92 provides a surface 98 against which fingers of an operator may be positioned for more control of the brush 50. Although the indentation 90 is shown, it is possible that the central base portion 54 on the back side 88 may not have the indentation 90 formed therein. By having one indentation 70 or 90 formed in the brush 50, a user of the brush 50 will be able to know which direction dye is being applied by the brush 50. For example, if the brush 50 is to be moved only in a downward direction then knowing that the indentation 70 is only on the front side 68 of the brush 50 will allow the user to be able to orientate the brush 50 for a downward stroke.

Figure 5:
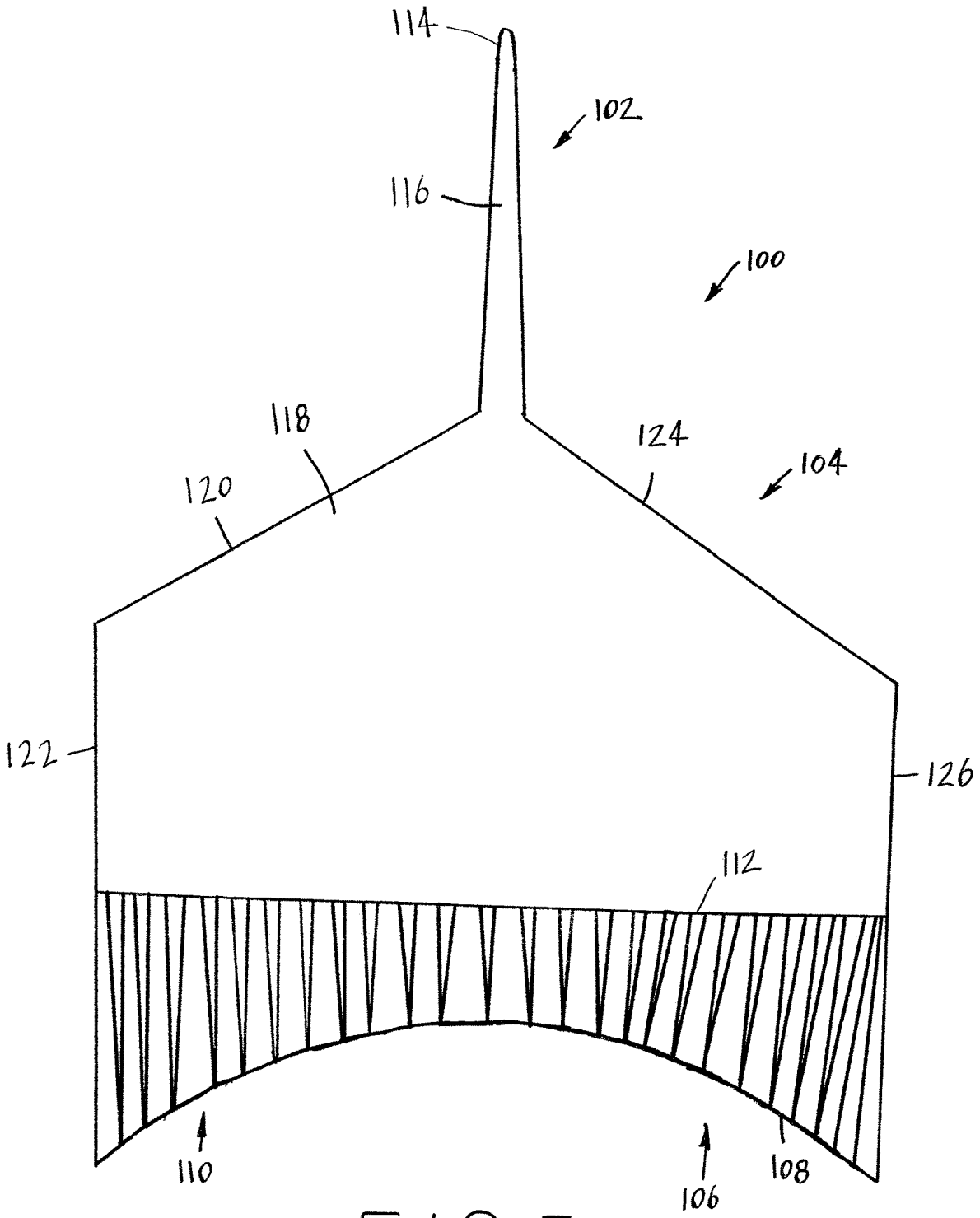
FIG. 5 is a front perspective view of another embodiment of a hair coloring brush constructed according to the present disclosure.

With particular reference now to FIG. 5, another embodiment of a hair coloring brush 100 is illustrated. The hair coloring brush 100 is shown comprising a pick handle 102, a central base portion 104, and a plurality of bristles 106 extending out from the central base portion 104. The bristles 106 each have an end portion 108 with the end portions 108 forming a curved surface 110. The central base portion 104 has a straight end portion 112 from which the bristles 106 extend. The pick handle 102 has an end 114 and a tapered portion 116 that extends from the central base portion 104 to the end 114. The pick handle 102 is used to assist in sectioning hair that needs to be colored or dyed by the brush 100. The central base portion 104 has a front side 118 that is large and is adapted for a hand of an operator of the brush 100 to be able to firmly grasp. The central base portion 104 also has a first angled side portion 120, a first straight side portion 122, a second angled side portion 124, and a second straight side portion 126. The first angled side portion 120 is between the tapered portion 116 and the first straight side portion 122. The first straight side portion 122 ends at the straight end portion 112. The second angled side portion 124 is between the tapered portion 116 and the second straight side portion 126. The second straight side portion 126 also terminates at the straight end portion 112. As can be appreciated, the curved surface 110 of the end portions 108 of the bristles 106 are used to follow the contoured shape of a head. In this manner, it will be easy to stroke hair with dye (not shown) applied to the brush 100 or apply dye to hair by using the brush 100.

Figure 6:
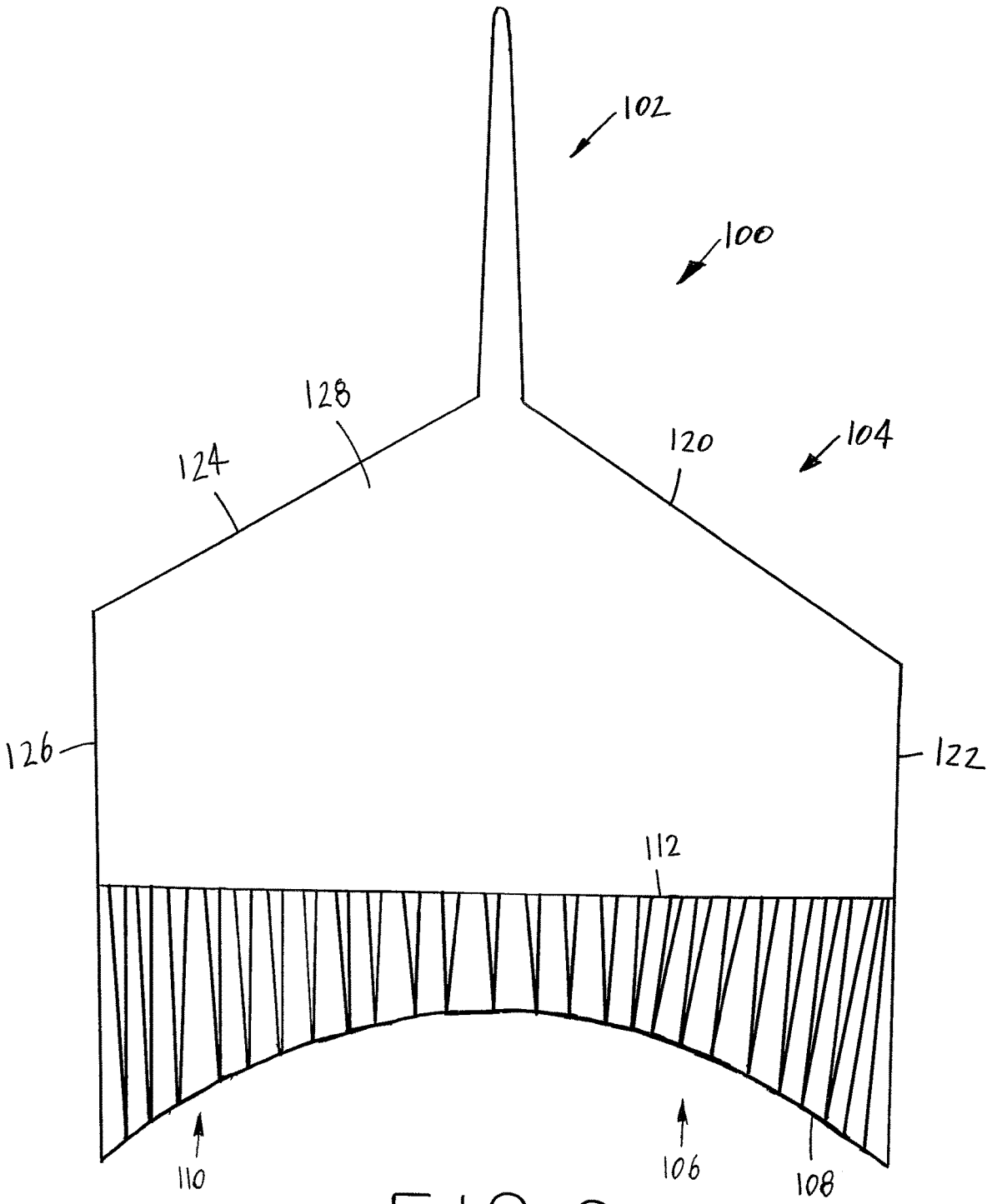
FIG. 6 is a back perspective view of the hair coloring brush shown in FIG. 5 constructed according to the present disclosure.

FIG. 6 illustrates a back perspective view of the hair coloring brush 100. The hair coloring brush 100 is shown comprising the pick handle 102, the central base portion 104, and the plurality of bristles 106 extending out from the central base portion 104. The bristles 106 each have the end portion 108 with the end portions 108 forming the curved surface 110. The central base portion 104 also has the straight end portion 112 from which the bristles 106 extend. The pick handle 102 has the end 114 and the tapered portion 116 that extends from the central base portion 104 to the end 114. The central base portion 104 has a back side 128 that is large and is adapted for a hand of an operator of the brush 100 to be able to firmly grasp. The central base portion 104 is also shown having the first angled side portion 120, the first straight side portion 122, the second angled side portion 124, and the second straight side portion 126.

Figure 7:
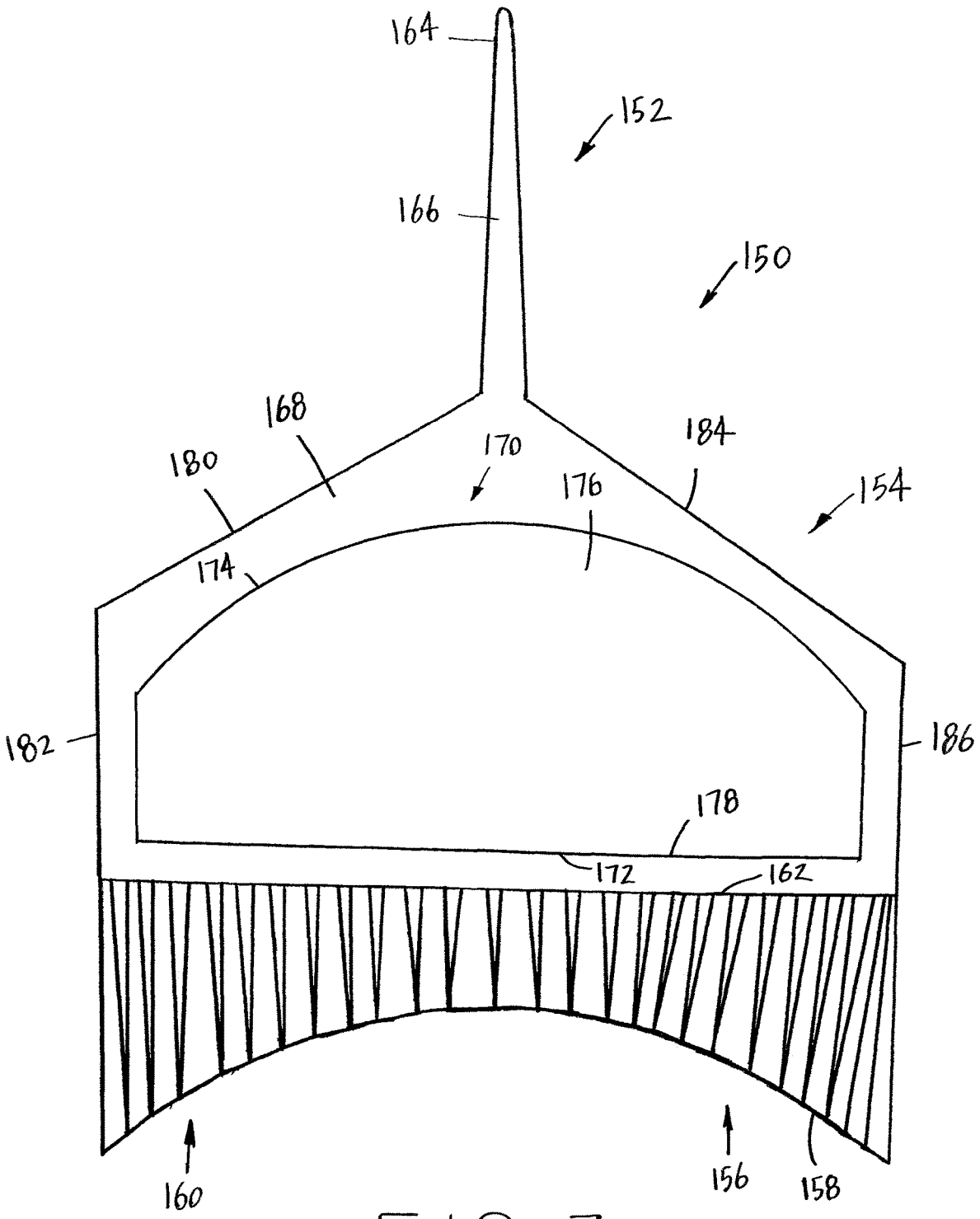
FIG. 7 is a front perspective view of another embodiment of a hair coloring brush constructed according to the present disclosure.

Referring to FIG. 7, another embodiment of a hair coloring brush 150 is shown comprising a pick handle 152, a central base portion 154, and a plurality of bristles 156 extending out from the central base portion 154. The bristles 156 each have an end portion 158 with the end portions 158 forming a curved surface 160. The central base portion 154 has a straight end portion 162 from which the bristles 156 extend. The pick handle 152 has an end 164 and a tapered portion 166 that extends from the central base portion 154 to the end 164. The pick handle 152 is used to assist in sectioning hair that needs to be colored or dyed by the brush 150. The central base portion 154 has a front side 168 that is large and is adapted for a hand of an operator of the brush 150 to be able to firmly grasp. The central base portion 154 has an indentation 170 formed in the front side 168. The indentation 170 has a straight bottom end 172 and a circular upper end 174. The indentation 170 provides an area 176 for grasping the brush 150 in a comfortable manner by an operator or use of the brush 150. The curved bottom end 172 provides a surface 178 against which fingers of an operator may be positioned for more control of the brush 150. The central base portion 154 also has a first angled side portion 180, a first straight side portion 182, a second angled side portion 184, and a second straight side portion 186. The first angled side portion 180 is between the tapered portion 166 and the first straight side portion 182. The first straight side portion 182 ends at the straight end portion 162. The second angled side portion 184 is between the tapered portion 166 and the second straight side portion 186. The second straight side portion 186 also terminates at the straight end portion 162. As can be appreciated, the curved surface 160 of the end portions 158 of the bristles 156 are used to follow the contoured shape of a head. In this manner, it will be easy to stroke hair with dye (not shown) applied to the brush 150 or apply dye to hair by using the brush 150.

Figure 8:
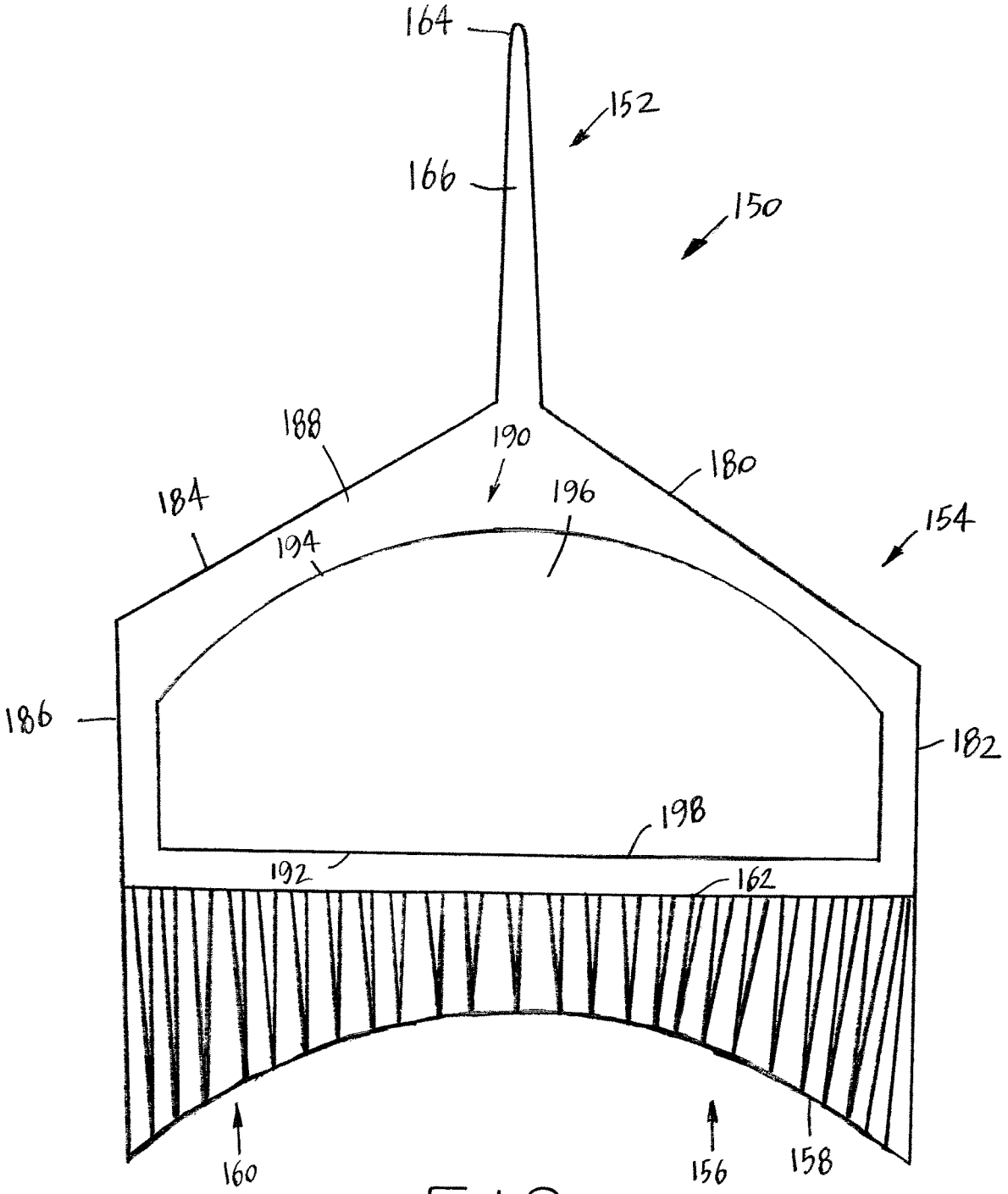
FIG. 8 is a back perspective view of the hair coloring brush shown in FIG. 7 constructed according to the present disclosure.

FIG. 8 illustrates a back perspective view of the hair coloring brush 150. The hair coloring brush 150 is shown comprising the pick handle 152, the central base portion 154, and the plurality of bristles 156 extending out from the central base portion 154. The bristles 156 each have the end portion 158 with the end portions 158 forming the curved surface 160. The central base portion 154 also has the straight end portion 162 from which the bristles 156 extend. The pick handle 152 has the end 164 and the tapered portion 166 that extends from the central base portion 154 to the end 164. The central base portion 154 has a back side 188 that is large and is adapted for a hand of an operator of the brush 150 to be able to firmly grasp. The central base portion 154 is also shown having the first angled side portion 180, the first straight side portion 182, the second angled side portion 184, and the second straight side portion 186. The central base portion 154 has an indentation 190 formed in the back side 188. The indentation 190 has a straight bottom end 192 and a circular upper end 194. The indentation 190 provides an area 196 for grasping the brush 150 in a comfortable manner by an operator or use of the brush 150. The straight bottom end 192 provides a surface 198 against which fingers of an operator may be positioned for more control of the brush 150.

Figure 9:
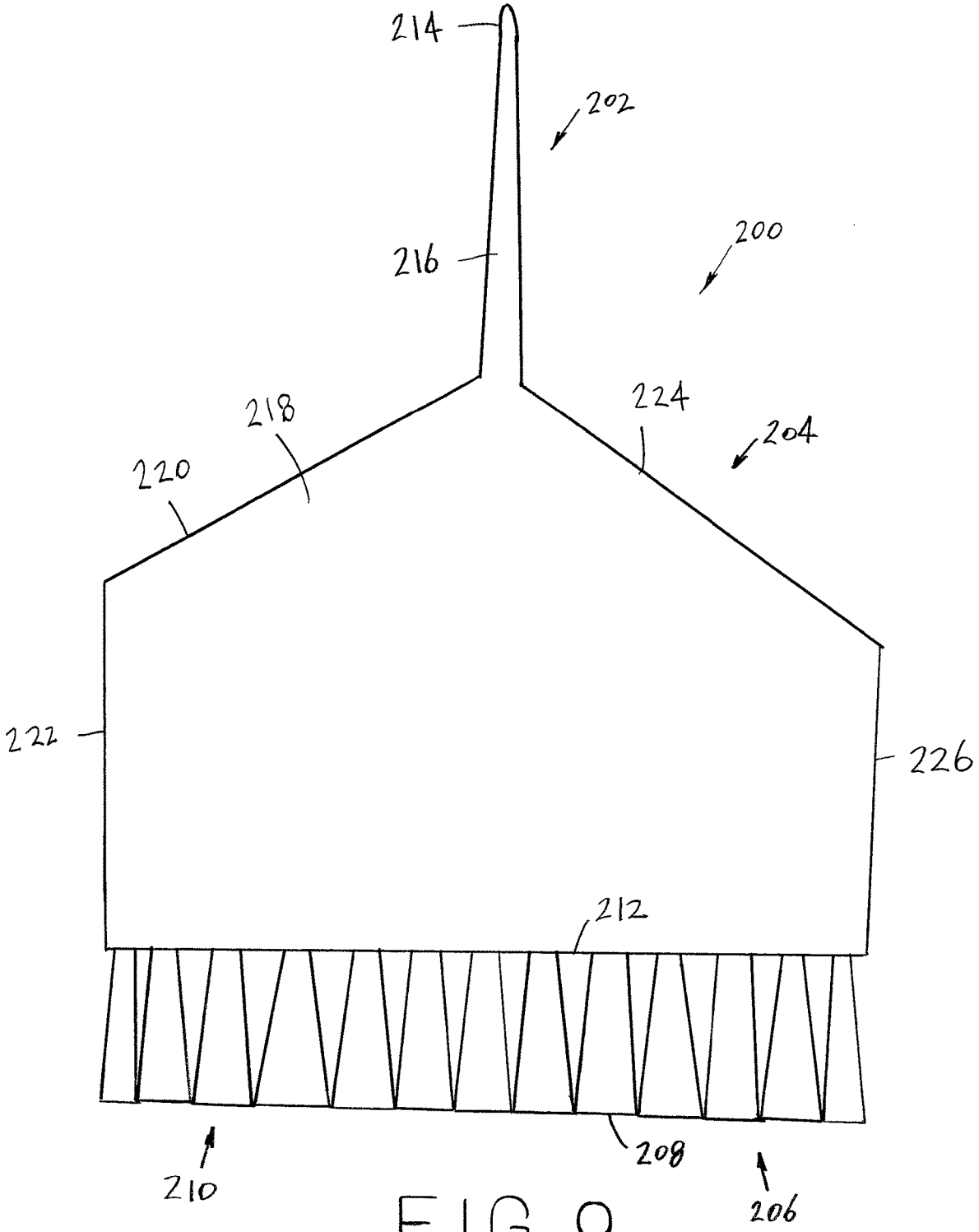
FIG. 9 is a front perspective view of another embodiment of a hair coloring brush constructed according to the present disclosure.

Referring to FIG. 9, another embodiment of a hair coloring brush 200 is shown comprising a pick handle 202, a central base portion 204, and a plurality of bristles 206 extending out from the central base portion 204. The bristles 206 each have an end portion 208 with the end portions 208 forming a straight surface 210. The central base portion 204 has a straight end portion 212 from which the bristles 206 extend. The pick handle 202 has an end 214 and a tapered portion 216 that extends from the central base portion 204 to the end 214. The pick handle 202 is used to assist in sectioning hair that needs to be colored or dyed by the brush 200. The central base portion 204 has a front side 218 that is large and is adapted for a hand of an operator of the brush 200 to be able to firmly grasp. The central base portion 204 also has a first angled side portion 220, a first straight side portion 222, a second angled side portion 224, and a second straight side portion 226. The first angled side portion 220 is between the tapered portion 216 and the first straight side portion 222. The first straight side portion 222 ends at the straight end portion 212. The second angled side portion 224 is between the tapered portion 216 and the second straight side portion 226. The second straight side portion 226 also terminates at the straight end portion 212. Although not shown, it is possible and contemplated that the central base portion 204 may have an indentation formed in the front side 218. Also, not visible in this particular is a back side of the brush 200. Again, the back side of the brush 200 may also have an indentation formed in the central base portion 204.

Figure 10:
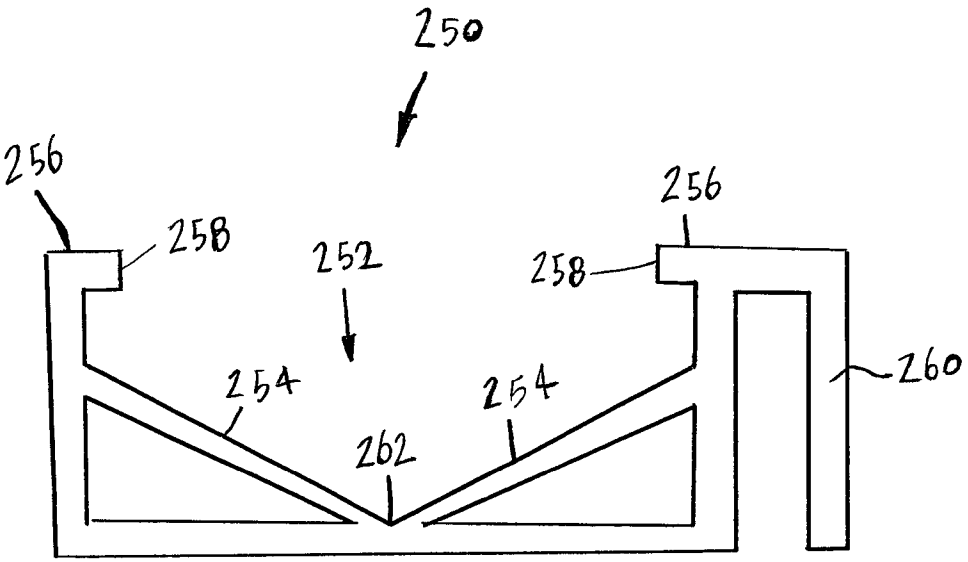
FIG. 10 is a cross-sectional view of an embodiment of a bowl for a hair coloring brush system constructed according to the present disclosure.

With particular reference now to FIG. 10, a cross-sectional view of a bowl or receptacle 250 used with any of the brushes 10, 50, 100, 150, or 200 to form a hair coloring brush system is shown. The bowl 250 comprises a basin portion 252 having an interior V-shaped wall 254, a rim 256, a ledge or a rest portion 258 positioned adjacent to the rim 256 in the basin 252, and a handle 260. The ledge 258 is used to place or rest any of the brushes 10, 50, 100, 150. or 200 thereon or against. The V-shaped wall 254 allows any chemicals, such as hair dye or hair color, to settle at a bottom 262 of the basin 252. The V-shaped wall 254 also allows the any of the brushes 10, 50, 100, 150, or 200 to rest therein and to be able to easily remove any of the brushes 10, 50, 100, 150, or 200. The handle 260 is used to stabilize the bowl 250. As can be appreciated, the basin 252 is large enough to allow any of the brushes 10, 50, 100, 150, or 200 to fit therein.

As can be appreciated, the brushes 10, 50, 100, 150, and 200 can be constructed of any suitable material such as plastic, polymer, metal, wood, or a combination of these materials. The bristles 16, 56, 106, 156, 206 may also be formed of any suitable material such as plastic, polymer, synthetic material, natural materials, or a combination of these materials. The brushes 10, 50, 100, 150, and 200 are suitable for single use or multiple uses. For example, the brushes 10, 50, 100, 150, and 200 can be disposable or can be cleaned of dye after each use and then used again to apply dye. It is also possible that the brushes may be manufactured in different colors so that the same brush may be used for applying the same color on different individuals.

Figure 11:
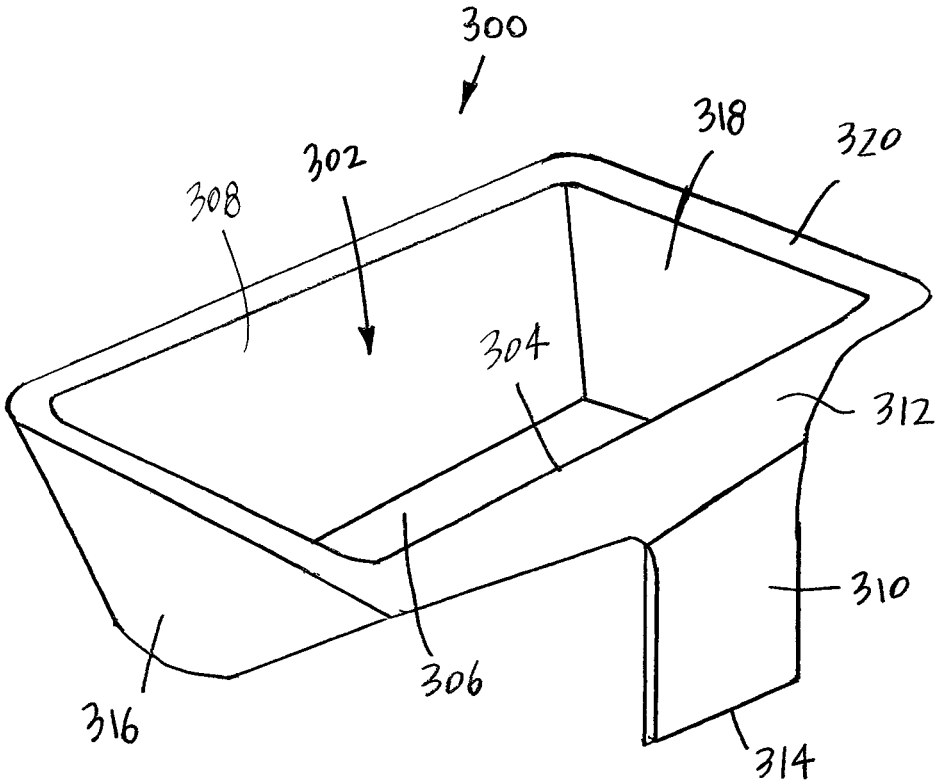
FIG. 11 is a perspective view of another embodiment of a bowl for a hair coloring brush constructed according to the present disclosure.

FIG. 11 illustrates another embodiment of a bowl or receptacle 300 that may be used with any of the brushes 10, 50, 100, 150, or 200. The bowl 300 comprises a basin or interior portion 302 having a slanted back wall portion 304, a bottom portion 306, and a front straight wall portion 308. The slanted back wall portion 304 is provided for resting any of the brushes 10, 50, 100, 150, or 200 when placed therein. The basin portion 302 is used to hold a dye for use in dyeing or coloring hair. For example, one or more dyes may be placed in the basin portion 302 to mix the desired color of dye therein. Once the desired color has been achieved any of the brushes 10, 50, 100, 150, or 200 may be placed into the dye. The bowl 300 also has a handle 310 that extends from a top portion 312. The handle 310 has a bottom portion 314 that is used to stabilize the bowl 300 when the bowl 300 is placed on a surface. As can be appreciated, the handle 310 may be grasped by a user to hold the bowl 300 next to a customer when dyeing the hair of the customer. The bowl 300 also has a pair of sides 316 and 318 and an upper lip portion 320 that are used to complete the formation of the basin portion 302. The upper lip portion 320 extends into the basin portion 302 and is used to keep dye within the bowl 300. The upper lip portion 320 is also used to provide a surface against which any of the brushes 10, 50, 100, 150, or 200 may be brushed against to remove excess dye. Although the upper lip portion 320 is shown extending from the pair of sides 316 and 38 and the front straight wall portion 308 it is also possible that the upper lip portion 320 only extends from the front straight wall portion. The basin portion 302 is sized and shaped to be able to contain or hold any of the brushes 10, 50, 100, 150, or 200 within the bowl 300.

Figure 12:
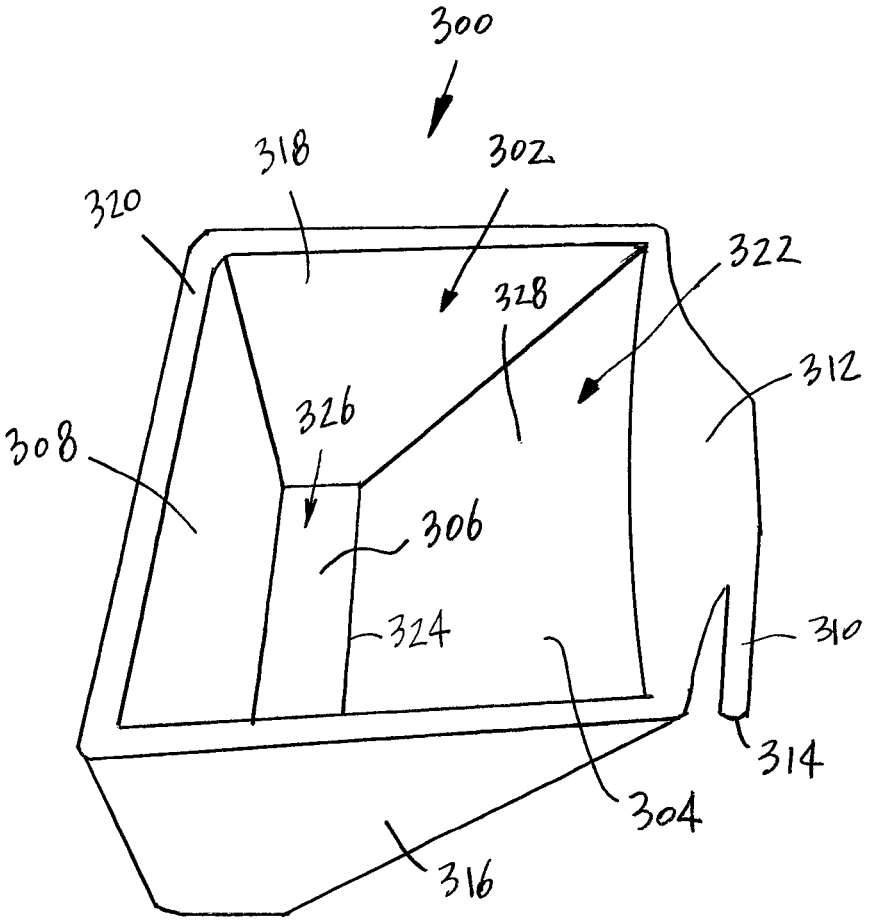
FIG. 12 is a top side perspective view of the bowl shown in FIG. 11.

FIG. 12 is a top side perspective view of the bowl 300. The bowl 300 is shown to comprise the basin or interior portion 302, the slanted back wall portion 304, the bottom portion 306, and the front straight wall portion 308. The slanted back wall portion 304 may have a convex or humped shape 322 having a bottom edge 324. The bottom portion 306 is formed between the front straight wall portion 308, the pair of sides 316 and 318, and the bottom edge 324 of the slanted back wall portion 304. The bottom portion 306 forms a ledge 326 for resting brush bristles, such as the bristles 16 of the brush 10 when the brush 10 is inserted into the bowl 300. The convex shape 322 of the slanted back wall portion 304 provides a surface 328 upon which bristles, again such as the bristles 16 of the brush 10, may contact when removing excess dye from the bristles 16 when removing the brush 10 from the bowl 300 during use. The bowl 300 is also shown to comprise the handle 310 extending from the top portion 312. The handle 310 has the bottom portion 314 that is used to support the bowl 300 on a flat surface during use or storage of the bowl 300. The bowl 300 also has the pair of sides 316 and 318 and the upper lip portion 320.

Figure 13:
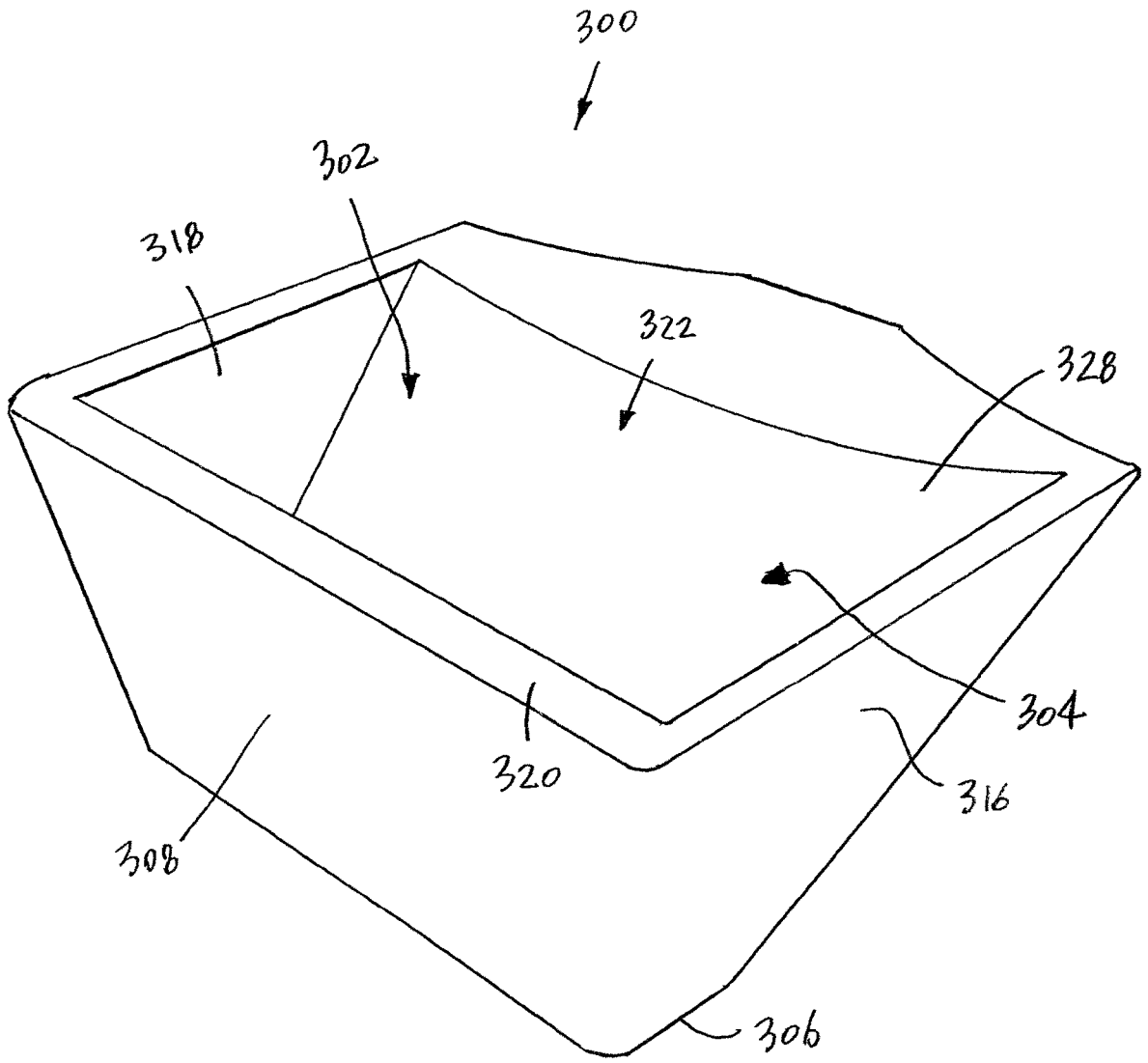
FIG. 13 is a front perspective view of the bowl shown in FIG. 11.

Turning now to FIG. 13, the bowl 300 is illustrated comprising the basin or interior portion 302, the slanted back wall portion 304, the bottom portion 306, and the front straight wall portion 308. The slanted back wall portion 304 has the convex shape 322. The convex shape 322 is wide enough that any of the brushes 10, 50, 100, 150, or 200 may fit within the bowl 300. The convex shape 322 presents the surface 328 upon which bristles associated with any of the brushes 10, 50, 100, 150, or 200 may contact or rest against during use. The bowl 300 is also shown to have the pair of sides 316 and 318 and the upper lip portion 320.

Figure 14:
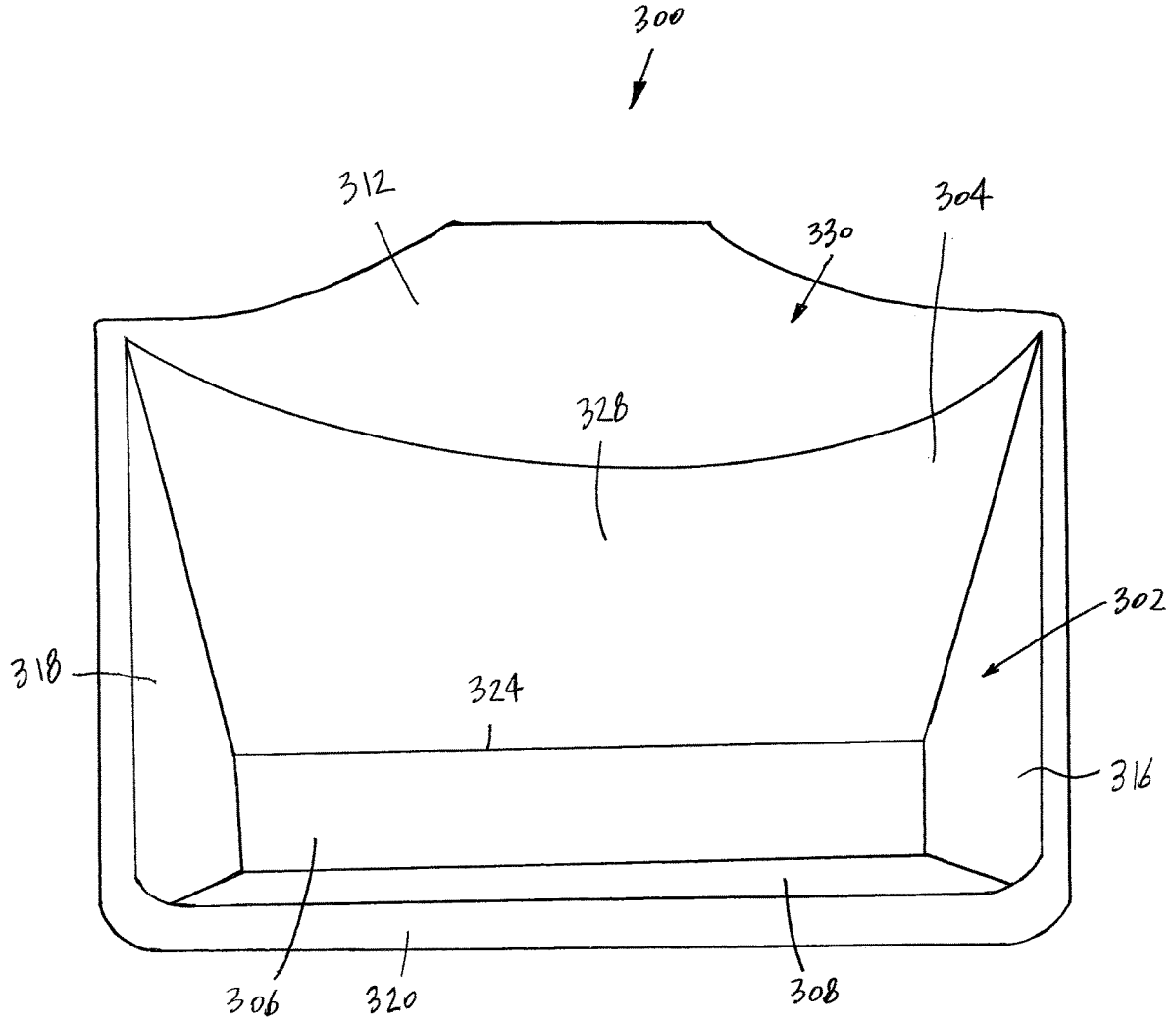
FIG. 14 is a top view of the bowl shown in FIG. 11.

FIG. 14 depicts a top view of the bowl 300. The bowl 300 is shown comprising the basin or interior portion 302, the slanted back wall portion 304, the bottom portion 306, and the front straight wall portion 308. The bottom portion 306 is formed between the edge 324 of the slanted back wall portion 304, the front straight wall portion 308, and the pair of sides 316 and 318. The upper lip portion 320 is wide and assists in preventing any dye in the bowl 300 from flowing down the front straight wall portion 308 and the pair of sides 316 and 318. The top portion 312 is also wide and will capture any dye from flowing down the handle 310. The top portion 312 also provides a surface 330 upon which a logo may be provided. As can be appreciated, the surface 328 may also be used for providing a logo thereon.

Figure 15:
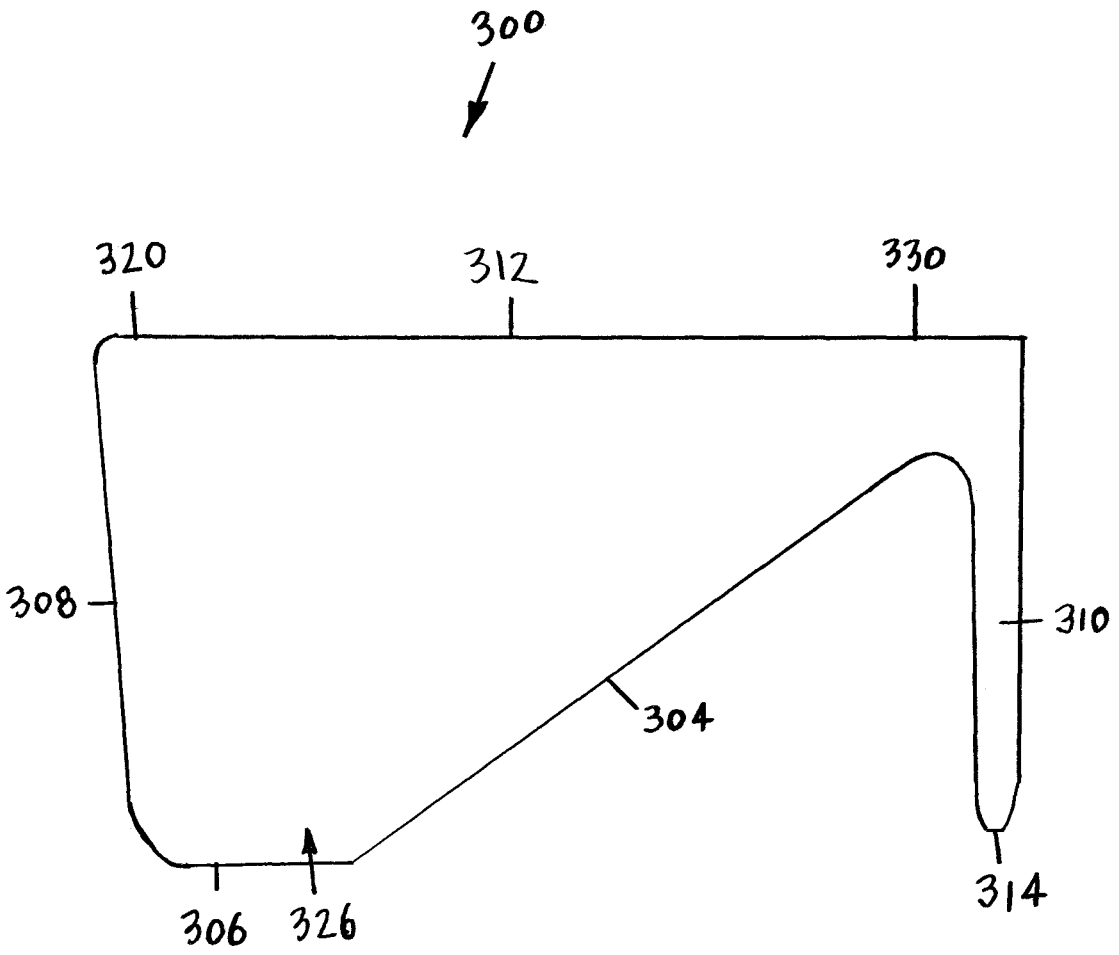
FIG. 15 is a side view of the bowl shown in FIG. 11.

With reference now to FIG. 15, a side view of the bowl 300 is illustrated. The bowl 300 is shown having the bottom portion 306 being formed between the slanted back wall portion 304 and the front straight wall portion 308. The bottom portion 306 forms the ledge 326 for placing bristles of a brush therein. The top portion 312 of the bowl 300 is shown in this particular view as being angled away from the upper lip portion 320. The handle 310 has the bottom 314 that is used to support the bowl 300 when the bowl 300 is placed on a surface.

In operation, the bowl 300 may be used with any of the brushes 10, 50, 100, 150, or 200 that have been disclosed herein. For example, the brush 10 may be used with the bowl 300 to form a hair coloring brush system in the following manner. A quantity of dye or coloring agent (now shown) may be placed within the bowl 300. As is known, the quantity of dye may consist of one or more colors that may be combined to obtain a desired color for use on an individual. The colors may be in the form of a liquid, a gel, or paste. Once the quantity of dye is finalized, the brush 10 may be inserted therein for use. Any excess dye that is on the bristles 16 may be wiped off against the surface 328 and then the dye may be applied to the hair of the individual being treated. The brush 10 may be returned to the bowl 300 for another application of dye or for temporary storage. Due to the size and shape of the bristles 16 and the use of the bowl 300, the dye may be quickly applied to the hair of the individual. Also, due to the use of the bowl 300 less dye is needed to color hair of an individual. The size and shape of the bowl 300 allows for better or more even dipping of any of the brushes 10, 50, 100, 150, or 200, less overlapping of color, and less waste of dye.

From all that has been said, it will be clear that there has thus been shown and described herein a bowl for use with a hair coloring brush and system which fulfills the various objects and advantages sought therefore. It will become apparent to those skilled in the art, however, that many changes, modifications, variations, and other uses and applications of the subject bowl are possible and contemplated. All changes, modifications, variations, and other uses and applications which do not depart from the spirit and scope of the are deemed to be covered by the subject mattress protector and removable cover assembly, which is limited only by the claims which follow.

What is claimed is:

1. A bowl comprising:

a basin portion having a slanted back wall portion having a convex shaped surface, and a bottom portion, a front straight wall portion, a pair of side wall portions with each side wall portion having a front straight portion, a top straight portion, a slanted back portion, and a straight bottom portion, and a top portion having a continuous upper lip portion, wherein the lip portion has a portion opposite the front straight wall portion having a convex shaped upper surface adjacent to the convex shaped surface of the basin portion, the continuous upper lip portion extending along the front straight wall portion, the pair of side wall portions, and the convex shaped upper surface, the continuous upper lip portion having a flat upper surface along the front straight wall portion, one of the pair of side wall portions, the convex shaped surface, and the other one of the pair of side wall portions and having no indentation along the flat upper surface; and a handle extending from the top portion adjacent to the portion having the convex shaped upper surface, the handle integrally formed with the basin and non-removably joined to the top portion.

2. The bowl of claim 1 wherein the handle further comprises a bottom handle portion for stabilizing the bowl when the bowl is placed on a flat surface.

3. The bowl of claim 1 wherein the slanted back wall portion comprises a bottom edge and the bottom portion is formed between the bottom edge of the slanted back wall portion, the front straight wall portion, and the pair of side wall portions.

4. The bowl of claim 3 wherein the bottom portion is rectangular in shape.

5. The bowl of claim 1 wherein the slanted back wall portion has an edge, the bottom portion extending between the edge and the front straight wall portion for forming a ledge.

6. The bowl of claim 1 wherein the bowl further comprises a logo provided on the portion having the convex shaped upper surface.

7. A bowl for use with a hair coloring brush comprising:

a basin portion having a slanted back wall portion having a convex shaped surface and a bottom portion, a front straight wall portion, a pair of side wall portions with each side wall portion having a front straight portion, a top straight portion, a slanted back portion, and a straight bottom portion, and a top portion having a continuous upper lip portion, wherein the lip portion has a portion opposite the front straight wall portion having a convex shaped upper surface adjacent to the convex shaped surface of the basin portion, the continuous upper lip portion extending along the front straight wall portion, the pair of side wall portions, and the convex shaped upper surface, the continuous upper lip portion having a flat upper surface along the front straight wall portion, one of the pair of side wall portions, the convex shaped surface, and the other one of the pair of side wall portions and having no indentation along the flat upper surface, the continuous upper lip portion having a width for preventing any dye in the basin portion from flowing outside of the basin portion down the front straight wall portion, the pair of side wall portions, or the convex shaped upper surface; and a handle extending from the top portion adjacent to the portion having the convex shaped upper surface, the handle integrally formed with the basin and non-removably joined to the top portion.

8. The bowl for use with a hair coloring brush of claim 7 wherein the handle further comprises a bottom handle portion for stabilizing the bowl when the bowl is placed on a flat surface.

9. The bowl for use with a hair coloring brush of claim 7 further comprising a logo provided on the slanted back wall portion.

10. The bowl for use with a hair coloring brush of claim 7 wherein the bottom portion is rectangular in shape.

11. The bowl for use with a hair coloring brush of claim 7 wherein the front straight wall portion has an edge, the bottom portion extending between the edge of the slanted wall portion and the edge of the front straight wall portion for forming the ledge.

12. The bowl for use with a hair coloring brush of claim 7 further comprising a logo provided on the portion having the convex shaped upper surface.

* * * * *